United States Patent [19]

Guillaumin

[11] 4,133,268

[45] Jan. 9, 1979

[54] RAILWAY BOGIE-TRUCKS AND METHOD OF MANUFACTURING SAME

[75] Inventor: Jean C. Guillaumin, L'Etang la Ville, France

[73] Assignee: Societe des Acieries de Paris et d'Outreau, Paris, France

[21] Appl. No.: 660,131

[22] Filed: Feb. 23, 1976

[30] Foreign Application Priority Data

Feb. 25, 1975 [FR] France ..... 75 05816

[51] Int. Cl.[2] ..... B61F 5/04; B61F 5/16; B61F 5/26; B61F 5/52

[52] U.S. Cl. ..... 105/202; 105/204; 105/206 R; 105/208; 105/226; 228/178

[58] Field of Search ..... 105/204, 199 C, 202, 105/206 A, 206 R, 208, 226; 228/178; 308/137

[56] References Cited

U.S. PATENT DOCUMENTS

| | | | |
|---|---|---|---|
| 768,901 | 8/1904 | Hopkins | 105/199 C X |
| 1,900,682 | 3/1933 | Alcott | 105/199 C X |
| 1,907,910 | 5/1933 | Wahlberg | 228/178 |
| 2,194,349 | 3/1940 | Almdale | 228/178 X |
| 2,222,484 | 11/1940 | Light | 105/206 R |
| 2,393,046 | 1/1946 | Keller | 105/206 R |
| 3,338,183 | 8/1967 | Boissier | 105/202 |
| 3,915,095 | 10/1975 | Briggs | 105/206 R X |

*Primary Examiner*—Lawrence J. Oresky
*Assistant Examiner*—Howard Beltran

[57] ABSTRACT

An improved railway stock railway rolling stock bogie truck includes a cross beam and a pair of spaced longitudinal side members with an asymmetrical cross-sectional configuration with the cross beam in alignment both with the bearing support and the side members.

4 Claims, 10 Drawing Figures

1
1a
1b
2
3
4
5
6
7
8
9
II
III

RAILWAY BOGIE-TRUCKS AND METHOD OF MANUFACTURING SAME

BACKGROUND OF THE INVENTION

The present invention relates to railway rolling-stock in general and has specific reference to bogie-trucks for railway cars and to the methods of manufacturing such bogie-trucks (designated hereinafter by the term "truck" for the sake of convenience).

The constant trend towards higher operating speeds in railway systems led inter alia to the development of rigid moulded-steel trucks, for these preserve their geometrical shape irrespective to the stresses applied thereto in actual service. As a rule, these trucks comprise a pair of parallel longitudinal side members supporting the journal or axle boxes and rigidly interconnected by a cross beam to which the central bearing support is attached by welding, this cross beam having its opposite ends fitted into the aforesaid longitudinal side members and welded thereto.

Experience teaches that these trucks are not fully satisfactory for the stresses produced in the attachment on the one hand between the cross beam and the longitudinal side members, and on the other between the central pintle bearing and the cross beam eventually develop cracks that are rather difficult to detect.

SUMMARY OF THE INVENTION

To avoid this serious inconvenience the present invention provides a method of manufacturing moulded steel trucks of the above-defined type which is characterized in that the cross beam and the longitudinal side members, on the one hand, and the central bearing support and the cross beam, on the other hand, are assembled to each other according to the butt-welding technique, i.e. with the parts to be welded in alignment with each other. Thus, stresses are reduced considerably for the welds are disposed in one or the other member in areas of reduced strain.

To this end, according to a preferred form of embodiment of the truck of this invention, the cross beam comprises three sections, i.e. a central, bearing-supporting section, and two lateral sections each welded to one end of the central section and having a shape so calculated that only minimum stresses are exerted on the area where each lateral section is connected to the relevant longitudinal side member, this shape being generally outflared. According to possible forms of embodiment, these end portions of the cross beam may either be cast integrally with the corresponding side member or be assembled with the latter by welding along a weld seam of adequate configuration according to the butt welding technique.

The cross beam according to this invention comprises on its upper face, around the central bearing support, a frustoconical, upswept portion either cast integrally with the cross-beam or forming an insert formed completely or partially by welding, with an end portion of same dimensions as the central bearing support and peripheral contour complementary to that of said bearing support; to this end, the edges of said bearing support are curved downwardly to provide in the area where the support is welded to the cross beam a frustoconical portion which is thus superposed and the upper frustoconical portion of said cross beam.

By virtue of this particular arrangement and configuration of the connecting portions between the cross beam and the longitudinal side members, on the one hand, and the central bearing support and the cross beam, on the other hand, any solution of continuity in the lines of force is safely avoided and the stresses applied to the central bearing support, for instance, are evenly distributed in the cross beam and the longitudinal side members.

The cross beam comprises on its vertical walls only one aperture located under the central bearing support, this aperture being necessary for assembly the truck.

According to another feature characterizing this invention each longitudinal side member has an asymetrical shape, along its median plane containing its longitudinal axis, in order better to distribute the lines of force transmitted by the outflaring portion of the cross beam and to provide a structure wherein the strength is properly balanced between the inner and outer portions of the longitudinal side member, the stresses from the cross beam tending to apply a greater load to the inner side than to the outer side. The side member shape contemplated for solving this problem has the following characteristics: the inner wall of the side member is a co-extension of the outerend, of major cross-section, of the cross beam, and comprises on either side of said cross beam an aperture, whereas the outer wall comprises a single central aperture extending on a relatively substantial distance towards the truck journal or bearing boxes.

On the other hand, since torsion stresses due to the lateral efforts transmitted by the journal or axle boxes are applied to the longitudinal side members, it occured that a substantially trapezoidal cross-sectional shape was the proper solution for increasing the strength of these side members.

With this configuration it is thus possible to obtain a harmonious shape for the areas where the side member body merges into the lugs carrying the shock-absorber studs.

Other features and advantages of this improved railway rolling-stock truck will appear more clearly as the following disclosure proceeds with reference to the accompanying drawings, in which:

DESCRIPTION OF THE PREFERRED EMBODIMENT

The improved truck or bogie for railway rolling-stock comprises essentially a fixed cross beam 1 interconnecting a pair of parallel spaced longitudinal side beams or members 2 carrying the journal or axle boxes (not shown).

Figures 1, 2, 3:
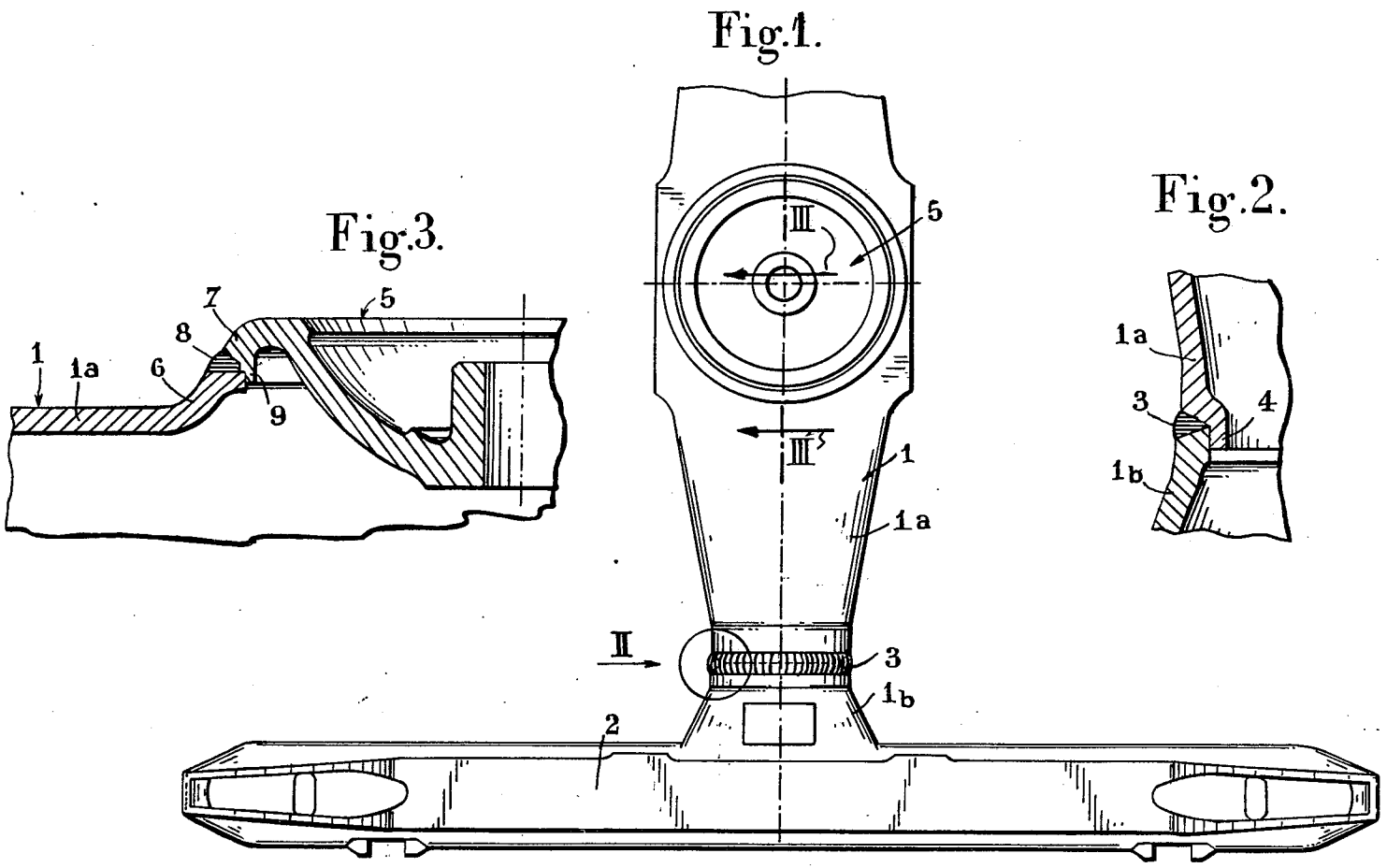
FIG. 1 is a fragmentary plane view from above of the truck.
FIGS. 2 and 3 are diagrammatic sectional views showing on a larger scale cross-sections taken in the area II and along the line III—III, respectively, of FIG. 1.

According to a primary feature characterising this invention, said cross beam 1 comprises a central section 1*a* assembled by welding to opposite lateral or end sections 1*b*, the ends to be welded together having the same dimensions and the same complementary contours so that they can be assembled by butt welding as shown at 3; to facilitate the proper alignment of the parts and also the welding operation proper, one of the butt ends may comprise as customary in the art an annular inner collar 4 adapted to be fitted into the other end (see FIG. 2).

The top surface portion of the crossbeam 1 which surrounds the bearing-receiving support 5 comprises a frustoconical upswept portion 6 having an upper end corresponding in size to, and a cross sectional contour matching that of, the bearing support 5. Furthermore, the outer peripheral portions of the bearing support 5 are curved downwardly in order to constitute, in the area where the support 6 is to be connected to the corresponding cross beam section 1*a* and as a continuation of this section, a frustoconical portion 7 adapted to be superposed to the frustoconical upswept portion 6 of the cross beam, in co-extension therewith, and the bearing support 5 is butt-welded to the beam along a seam 8; to improve the centering of the bearing support 5 with respect to the cross beam and facilitate the welding operation proper, the bearing support 5 may comprise an integral peripheral annular inner collar 9 adapted to fit into the frustoconical portion 6 of beam 1*a;* if desired, this annular collar 9 may be provided on the cross beam section 1*a* for engagement in a matching portion of the bearing support 5.

The central section 1*a* of the beam may if desired have a substantially rectangular cross-section; however, this shape is not the ideal one for withstanding the composite flexion and torsion stresses applied to this member under actual service conditions.

Therefore and according to another essential feature characterizing this invention, a different polygonal shape is more adequate for the purpose and in a preferred form of embodiment an irregular hexagon is contemplated in order to provide a better compromise between the rectangular shape and the circular shape.

According to another feature characterizing this invention the longitudinal side beams 2 have an asymetrical shape in longitudinal section taken along the median plane containing the longitudinal center line.

Figure 4:
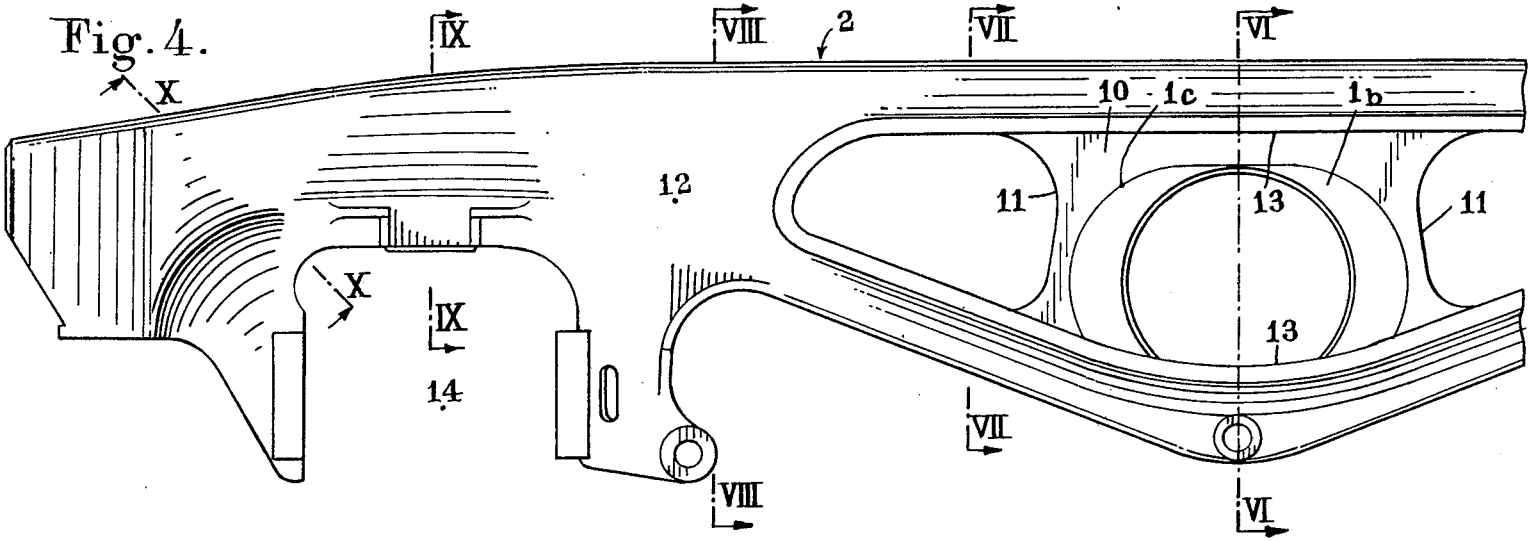
FIGS. 4 and 5 are fragmentary views of a longitudinal side beam, as seen in side elevational view and top plane view, respectively, and FIGS. 6 to 10 inclusive are views showing cross sections of various parts of the longitudinal side beam, as taken along the lines VI—VI to X—X of FIG. 4, respectively.
Figure 5:
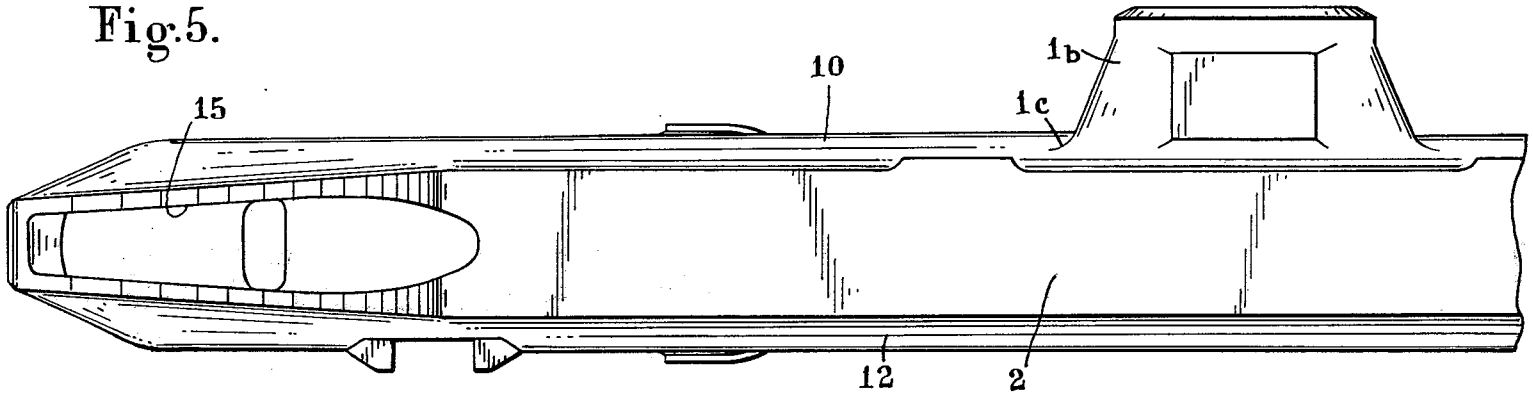
Figure 6:
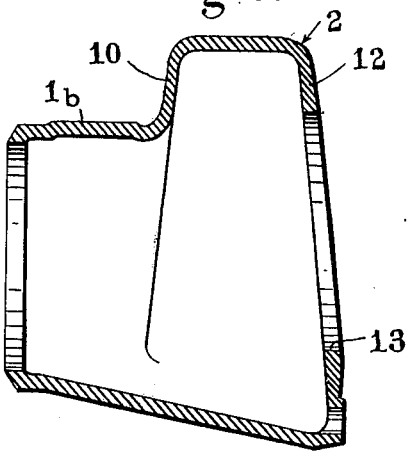
Figure 7:
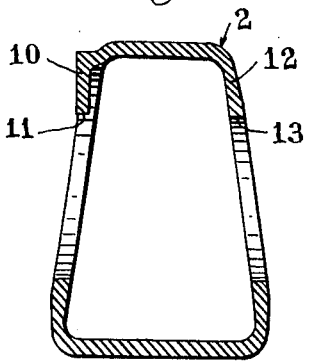
Figure 8:
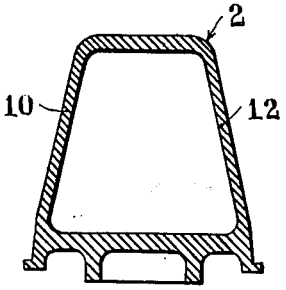

FIGS. 4 and 5 illustrate notably that the inner wall 10 of side member 2 constitutes an extension of the outflared side 1*c* of the end portion 1*b* having the major cross-sectional area of cross beam 1, and that said wall 10 has formed there on either side of said cross beam an aperture 11, whereas the outer wall 12 comprises a single central aperture 13 extending to within a relatively short distance from the cavity 14 intended for mounting the journal or axle boxes.

FIGS. 6 to 10 of the drawings further illustrate that, still according to a complementary feature characterizing this invention, the cross-sectional shape of the side members 2 is substantially trapezoidal to permit a better distribution of the lines of force transmitted from the cross beam 1 and provide a structure of same strength between the inner wall 10 and the outer wall 12 of the side member, the efforts transmitted from the cross beam tending to be applied more to the inner wall than to the outer wall.

Figure 9:
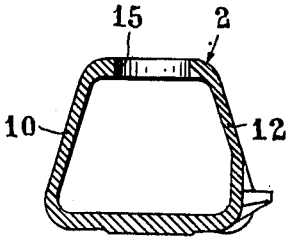
Figure 10:
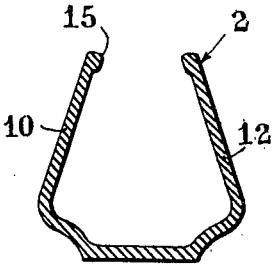

FIGS. 9 and 10 illustrate that an aperture 15 is formed on the top surface of each side member 2 and that this aperture extends to a point overlying the corresponding journal box cavity 14.

Of course, various modifications and changes may be brought to the specific form of embodiment of truck described hereinabove with reference to the attached drawings, without inasmuch departing from the basic principles of the invention as set forth in the appended claims.

Having described the invention, what is claimed as new is:

1. Rigid cast steel bogie truck for railway rolling stock, of the type comprising a single hollow cross beam and a pair of parallel longitudinal side members having each a hollow structure with a lateral inner wall and a lateral outer wall and two journal box cavities, said cross beam comprising a central section having two circular ends, and a pair of end sections, said central section includes a rigid bolster, each end section of said cross beam being rigid with said side members, and extending substantially inwardly towards said central section from, a central area of a corresponding longitudinal side member, each end section of said cross beam further having a substantially frustoconical configuration with a base and an apex, the base merging into the inner wall of the corresponding side member, and the apex being butt-welded to a corresponding circular end of said central section of the cross beam.

2. A bogie truck according to claim 1, wherein said cross beam has on its upper face a central open portion having an upswept downwardly outflaring frustoconical configuration, said central section having a bearing support being connected to said central open portion and having a downswept downwardly outflaring frustoconical configuration.

3. Cast steel bogie truck as recited in claim 1, wherein the cross section of each longitudinal side member, on each side of said central area, has a substantially trapezoidal configuration with a minor base and a major base, the major base underlying the minor base.

4. A bogie truck according to claim 1, wherein each longitudinal side member has an inner wall comprising an aperture on each side of the respective cross beam end portion and an outer wall comprising a single central aperture extending to within a relatively short distance of said journal box cavities.

* * * * *